US006282722B1

(12) United States Patent
Pogachar

(10) Patent No.: US 6,282,722 B1
(45) Date of Patent: Sep. 4, 2001

(54) PROTECTIVE LEATHER, OR LIKE MATERIAL, FACE AND NECK BANDANA WITH INTERCHANGEABLE, TWO-PLY FLANNEL, OR LIKE MATERIAL, LINER ATTACHED WITH SNAP PRESSURE CLOSURES

(76) Inventor: Jane Christine Pogachar, 21338 Dewdney Trunk Road, Maple Ridge, B.C. (CA), V2X 3G3

( * ) Notice: Subject to any disclaimer, the term of this patent is extended or adjusted under 35 U.S.C. 154(b) by 0 days.

(21) Appl. No.: 09/179,590

(22) Filed: Oct. 27, 1998

(51) Int. Cl.[7] ..... A42B 1/18
(52) U.S. Cl. ..... 2/206; 2/207
(58) Field of Search ..... 2/206, 207, 171, 2/9, 468, 173, DIG. 11

(56) References Cited

U.S. PATENT DOCUMENTS 2,519,512 * 8/1950 Stone ..... 2/171
3,105,970 * 10/1963 Herzberg ..... 2/91
4,468,817 * 9/1984 Nunnery et al. ..... 2/181
5,025,508 * 6/1991 Duncan ..... 2/207
5,035,006 * 7/1991 Hetz et al. ..... 2/209.11
5,058,211 * 10/1991 Hanks ..... 2/206
5,915,532 * 6/1999 Williams ..... 2/171

* cited by examiner

*Primary Examiner*—John J. Calvert
*Assistant Examiner*—Tejash Patel

(57) ABSTRACT

A protective face cover that can act as a neck warmer or a bandana to protect the cheeks and nose from cold, wind and dust, fumes and sand when recreating with fast moving open vehicles or sports. Two separate items join to form one as in an outer piece, wind and waterproof fabric or leather, and an inner, changeable, washable soft cloth as flannel or polar fleece liner. A simple triangular shape is joined behind the neck by means of snaps, stressing the use of snaps rather than any Velcro fastenings. Snaps are also used to join the liner to the outer piece. The liner is washable, & lightweight, so spare liners can be carried to replace wet or soiled liners. The liner is engineered for utmost comfort by having two layers, the snaps placed on one layer and the other layer then attached by sewing so the snaps do not come in contact with the face. The item is also designed to be aesthetically pleasing.

3 Claims, 2 Drawing Sheets

PROTECTIVE LEATHER, OR LIKE MATERIAL, FACE AND NECK BANDANA WITH INTERCHANGEABLE, TWO-PLY FLANNEL, OR LIKE MATERIAL, LINER ATTACHED WITH SNAP PRESSURE CLOSURES

CROSS REFERENCE TO RELATED APPLICATIONS

| U.S. REFERENCES: | | | |
|---|---|---|---|
| 5,265,280 | 5,214,800 | 5,293,646 | 5,251,336 |
| 5,233,704 | 5,086,629 | 5,493,732 | 5,091,996 |
| 5,072,460 | 5,048,128 | 5,025,506 | 4,610,247 |
| 4,654,897 | 5,016,288 | 4,961,232 | 5,337,419 |
| 3,605,121 | 5,287,560 | 5,253,369 | 4,942,627 |
| 4,894,865 | 3,768,099 | 4,870,707 | 4,825,474 |
| 4,300,240 | 5,265,279 | 3,935,597 | 4,468,818 |
| 5,025,508 | 5,058,211 | 5,035,006 | 5,214,804 |

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

This invention relates to protective coverings for the face and neck that are needed when working in hazardous conditions or using fast moving vehicles or engaging in sports that involve high speed, open air, cold temperature, dust or airborne particulate.

Many materials have been introduced to mimic leather, whereas this invention will use leather preferrably so as to provide the best air dam. Similar leather articles have a fabric liner sewn to the leather and we found this to be a serious drawback to the working article. In order to accommodate sanitary considerations associated with the face, mouth, nose, and neck, the inner liner is washable and interchangeable. It is made of flannel, or like material, in two layers to accomodate the design of having no metal come in contact with the face, or the skin on the back of the neck, it uses snap closures to both adhere the flannel liner to the outer leather dam, and to fasten the entire bandana together at the back of the neck.

Many similar articles use Velcro to fasten around the neck and this product is designed to avoid the problem of Velcro degradation and hair catching in the Velcro fastening. This invention seeks to provide both protection and comfort, while establishing a visual image that is aesthetically pleasing.

BRIEF SUMMARY OF THE INVENTION

This invention is directed to a bandana type mask for the face, cheeks and neck, to protect the area from wind, extreme cold, sand, fumes, rain, sleet, insects, branches and other airborne debris that is encountered when recreating or working with fast moving sports or open vehicles (motorcycles, skiing, horseriding, dune buggy, etc.). Sanitary conditions arise from the invention covering the mouth and nose. Actions such as smoking or sneezing can cause a need to wash the bandana. Because of the superior protection quality of leather, or like material, is integral to the design of the invention, the characteristic of being unable to wash leather had to be overcome.

An inner liner was conceived to adhere to the inside of the leather bandana, made of cloth of various types, by way of a series of plus or minus 9(nine) male/female pressure closures, commonly called "snaps", with the female half adhered to the leather. The snaps male half is attached to the piece of flannel hereinafter called the first flannel piece, and lays against the leather, while the second flannel piece is sewn to the first flannel piece in such a way as no metal comes in contact with the face or neck.

To provide for a preference in tightness around the neck, the closed circumference can be adjusted by a series of plus or minus 4(four) snaps in a line that are designed, consistent with the liner, so that no metal comes in contact with the back of the neck. Snaps were used to remedy the use of Velcro for adjustable closures in the vicinity of any hair as Velcro catching in hair is very painful, and Velcro has been found to deteriorate,

DRAWINGS AND DESCRIPTION

Figure 1:
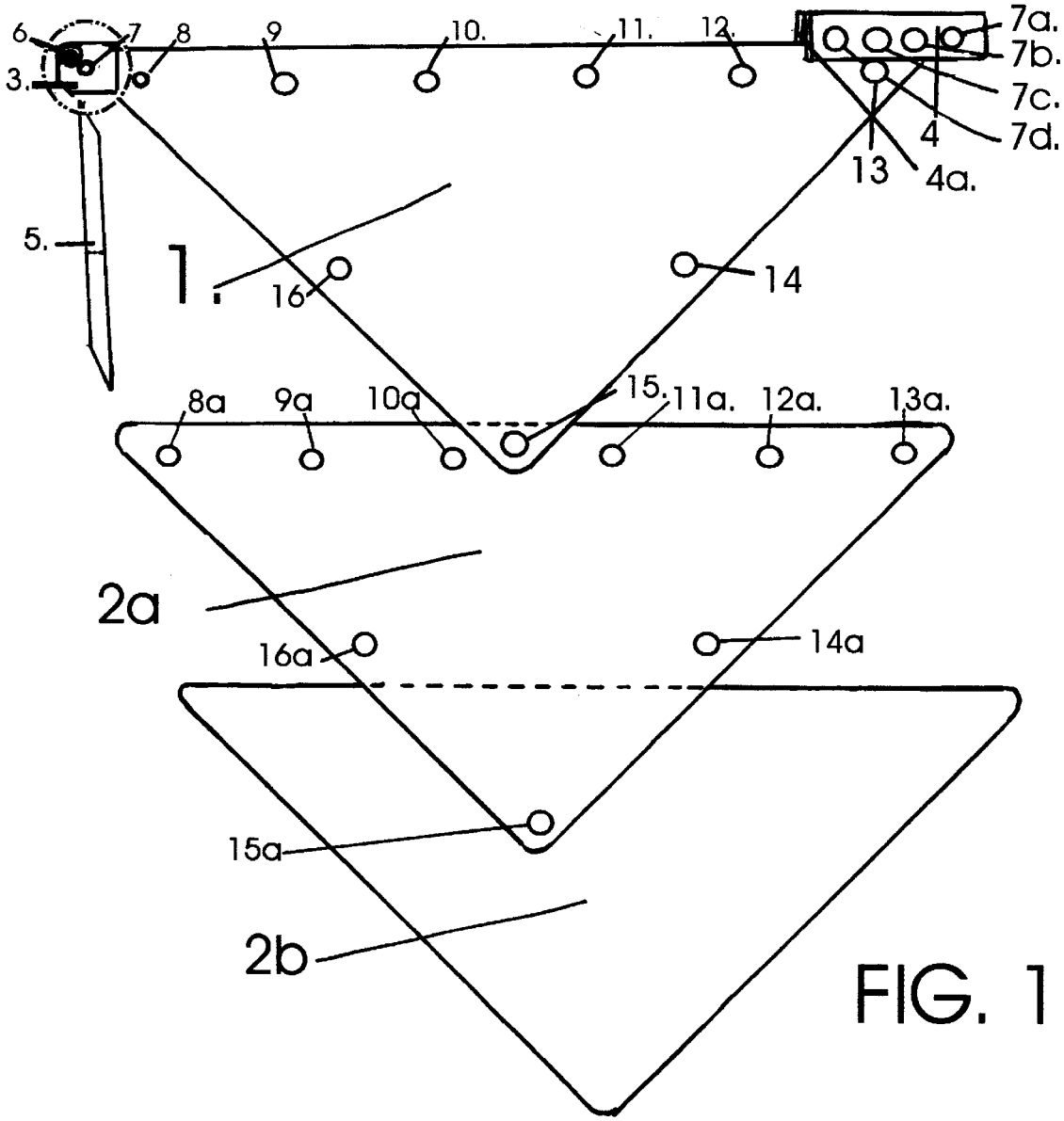
FIG. 1 is a frontal view of the invention with the flannel liner partly exploded.
Figure 2:
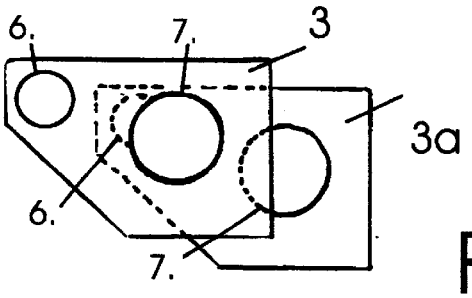
FIG. 2 is an enlargement of FIG. 1 showing the female snap closure of the fixing adjustment with rivet for easy release tag.
Figure 3:
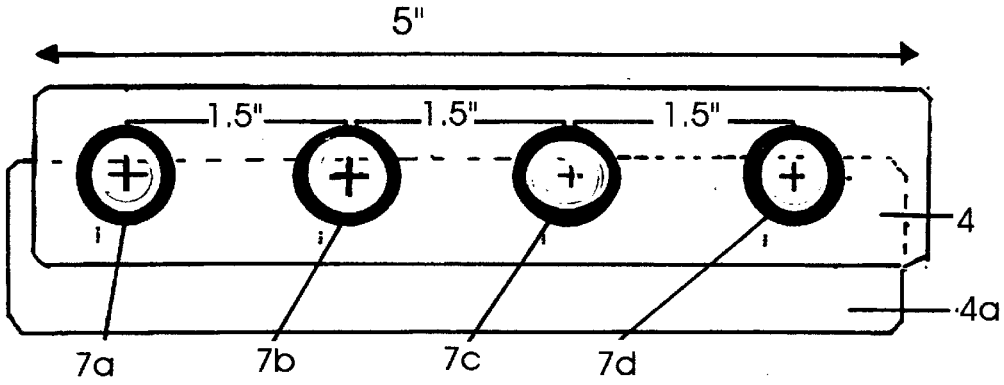
FIG. 3 is an enlargement of FIG. 1 showing four male snap closures on the adjustment piece.
Figure 4:
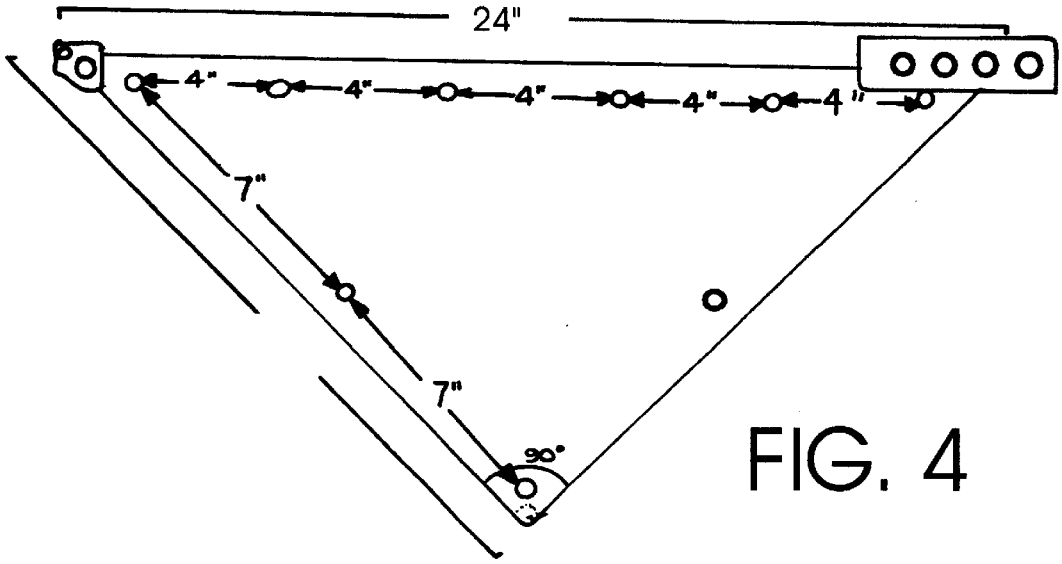

FIG. 4 contains approximate measurements of the invention.

Figure 5:
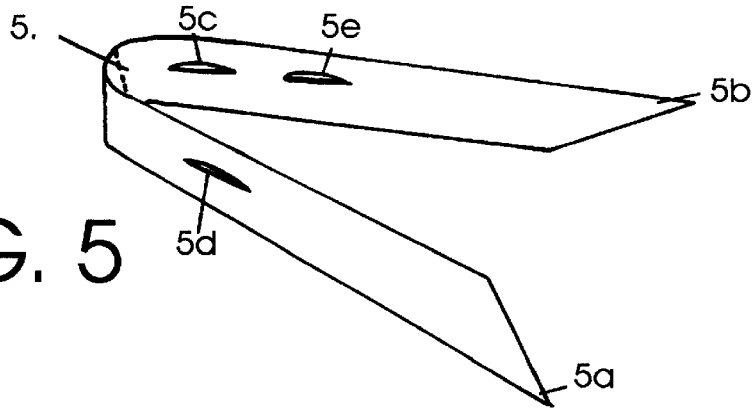

FIG. 5 shows the easy release tag.

The protective mask illustrated is comprised of a leather triangle 1 to which is affixed a reinforcing tab 3 and backing 3*a* to accomodate a female fixing snap 7 and an eye rivet 6 through which the easy release tag 5 is threaded. Tab 3, 3*a* and tab 4 must be sewn to the triangle 1 before attaching any of the snaps. The female snaps are designated 7 through 16 and the male snaps that correspond are designated with that number plus an alphabetic lower case 7*a,b,c,d*, 8*b*, 9*b*, 10*b*, etc. Tab 3 and 3*a* are sandwiched over the left top corner of the triangle, while tab 4 is sewn to the top right corner so that 1 inch of its 5 inches protrudes past the end. Tab 4 has the four snap holes punched while tab 4*a* is intact and sewn to tab 4 after the snaps are installed. This covers any hard surface to achieve the design concept of no hard surfaces touching the skin, as does the installing of the male snaps 8*a* through 16*a* on flannel piece 2*a* with a 1"×1" piece of the same flannel as reinforcement under each male snap on 2*a*, and then sewing 2*b* to 2*a* in such away that the back of the male snaps is hidden between the two layers of flannel.

The use of the invention is quite simple, being, attach the flannel liner 2*a*+2*b* to the outer leather dam 1, and fasten the entire invention at the back of the neck by means of the four adjustment positions according to individual comfort. The invention can be brought up to cover the cheeks, nose or mouth, or worn under the chin level as conditions dictate.

The embodiments of the invention in which an exclusive property or privilege is claimed are defined as follows:

1. A protective face and neck bandana that is comprised of a triangle shaped outer leather, or like material piece and a similar shaped inner liner that is two ply fabric and attaches to the outer leather piece by means of plus or minus 9 (nine) pressure snap fasteners allowing the inner liner to be removed easily, changed and washed to remain sanitary considering proximity to the face and nose and mouth.

2. A protective face and neck bandana as defined in claim 1 where the design is such that no metal or hard surface from the snaps comes in contact with the skin and the uniformity of the fastener positions enable any liner to fit any outer leather piece.

3. A protective face and neck bandana as defined in claim 1, which uses a series of four male pressure snap closures to one female pressure snap closure to accomodate adjustment of the circumference of the article when fastened about the neck, and uses a strip of leather that is specially braided to facilitate the removal of the article.

* * * * *